US006382295B1

(12) United States Patent
Nicholson

(10) Patent No.: US 6,382,295 B1
(45) Date of Patent: May 7, 2002

(54) MINI-BLIND/CURTAIN ROD BRACKET

(76) Inventor: Jerome Nicholson, 903 37th St., Newport News, VA (US) 23607

( * ) Notice: Subject to any disclaimer, the term of this patent is extended or adjusted under 35 U.S.C. 154(b) by 530 days.

(21) Appl. No.: 08/838,266

(22) Filed: Apr. 17, 1997

(51) Int. Cl.[7] ..... E06B 9/38

(52) U.S. Cl. ..... 160/178.1 R; 160/902; 248/254; 248/267

(58) Field of Search ..... 160/178.1 R, 173 R, 160/168.1 R, 38, 39, 902; 248/267, 252, 254, 255, 264, 268

(56) References Cited

U.S. PATENT DOCUMENTS 2,267,160 A * 12/1941 McKerlie ..... 248/264
2,549,905 A * 4/1951 Jablon ..... 160/902 X
2,568,001 A * 9/1951 Harris ..... 248/264
2,594,655 A * 4/1952 Junkunc ..... 248/252 X
2,792,999 A * 5/1957 Lorentzen ..... 248/264
2,916,246 A * 12/1959 Radel ..... 248/264
3,907,240 A * 9/1975 Belli ..... 248/268 X
4,071,215 A * 1/1978 Marotto ..... 248/264 X
4,177,853 A * 12/1979 Anderson et al. . 160/178.1 R X
4,226,395 A * 10/1980 Bellinger ..... 248/255 X
4,265,423 A * 5/1981 Vecchiarelli ..... 160/902 X
4,580,753 A * 4/1986 Hennequin ..... 160/902 X
4,848,432 A 7/1989 Connolly
4,889,305 A * 12/1989 Mahan ..... 248/268 X
5,188,162 A * 2/1993 Simon et al. ..... 160/902 X
5,265,837 A * 11/1993 Marocco ..... 160/902 X
5,505,418 A 4/1996 Corcoran
5,544,692 A * 8/1996 McMichael ..... 160/38 X

* cited by examiner

*Primary Examiner*—David M. Purol
(74) *Attorney, Agent, or Firm*—Millen, White, Zelano & Branigan, P.C.

(57) ABSTRACT

A bracket system is provided which is selectively convertible between a first mode in which it supports a mini-blind and a second mode in which it supports a curtain rod. The bracket system includes a mini-blind bracket and a curtain rod adapter. The mini-blind bracket forms a chamber defined by top and bottom walls, a back wall, and a side wall. The chamber is open along one side and along its front. A channel is formed in the top and bottom wall by flanges and grooves, and is sized to receive the adapter. The adapter comprises a plate which fits in the channel and which has a T-member sized and shaped to receive the end of a standard curtain rod. The adapter is easily slid into and out of the bracket to convert the bracket between its two modes.

17 Claims, 3 Drawing Sheets

MINI-BLIND/CURTAIN ROD BRACKET

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

This invention relates to curtain and blind brackets, and in particular, to a bracket which may be adapted to be used with either mini-blinds or curtain rods.

Both mini-blinds and curtains are popular forms of window dressing. If a homeowner wants to replace mini-blinds with curtains, he or she must take down the mini-blind brackets and mount curtain rod brackets in their stead. This is a time consuming process. It leaves holes in the window frame where mini-blind brackets were mounted to the window frame and requires that new holes be made where the curtain brackets are mounted to the window frame. When one bracket is taken down and replaced with the other bracket, the holes from the first bracket can still be visible. Such visible holes are unsightly and undesirable. If the window frame is painted wood, the holes can be filled and the frame repainted. This will hide the hole, but again, is a time consuming job. If the window frame is finished or unpainted wood, it is not possible to easily hide the hole, and the hole will remain visible.

BRIEF SUMMARY OF THE INVENTION

One object of the present invention is to provide a window dressing bracket which may be converted between a mini-blind bracket and a curtain rod bracket.

Another object is to provide such a bracket in which there is no additional part that need be mounted to the wall to convert the bracket from a mini-blind bracket to a curtain rod bracket, or vice-versa.

Another object is to provide such a bracket which is simple to convert between a mini-blind bracket and a curtain rod bracket.

These and other objects will become apparent to those skilled in the art in light of the following description and accompanying drawings.

Briefly stated, a bracket is provided which is selectively convertible between a first mode in which it supports a mini-blind and a second mode in which it supports a curtain rod. The bracket includes a bracket and an adapter. The bracket is adapted to be mounted to the window casement and has a rear wall, a bottom wall, a top wall, and a side wall, which, in combination, define a chamber having an open front and an open side. The chamber is sized to receive a header of the mini-blind. The top and bottom walls of the bracket have opposed channels formed to face each other. The channels in the top and bottom walls of the bracket are defined by a pair of flanges which face each other and which extend into the chamber from the top and bottom walls of the bracket. One of the pair of flanges has a lip which faces or extends toward the other of flange to form a generally L-shaped channel. The channel is formed at the open end of the chamber, but may be positioned anywhere relative to the chamber.

The curtain rod adapter has a plate sized to extend between the top and bottom walls of the bracket and to be received in the channels and a generally T-shaped member sized and shaped to receive an end of a curtain rod. The curtain rod adapter plate has an upper flange and a lower flange which are sized and shaped to be received in the L-shaped channel.

In a second embodiment, the curtain rod adapter plate can be provided with two spaced apart T-shaped curtain rod receiving members. And in anther embodiment, the T-shaped member can extend a wall of the bracket to be generally co-planar with the rear wall of the bracket. In this instance, the bracket can be provided with a closing plate to close the open side of the bracket, or the bracket can be provided with the adapter plate which has one, or even two, T-members so that multiple curtain rods can be mounted with the bracket.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 1:
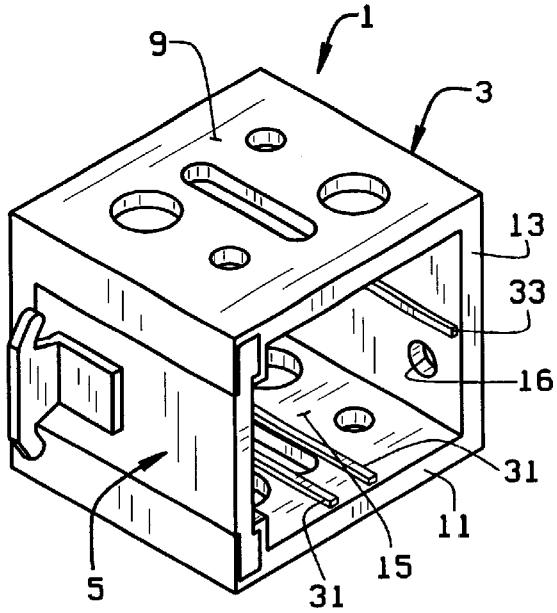
FIG. 1 is a perspective view of a bracket system of the present invention.
Figure 7:
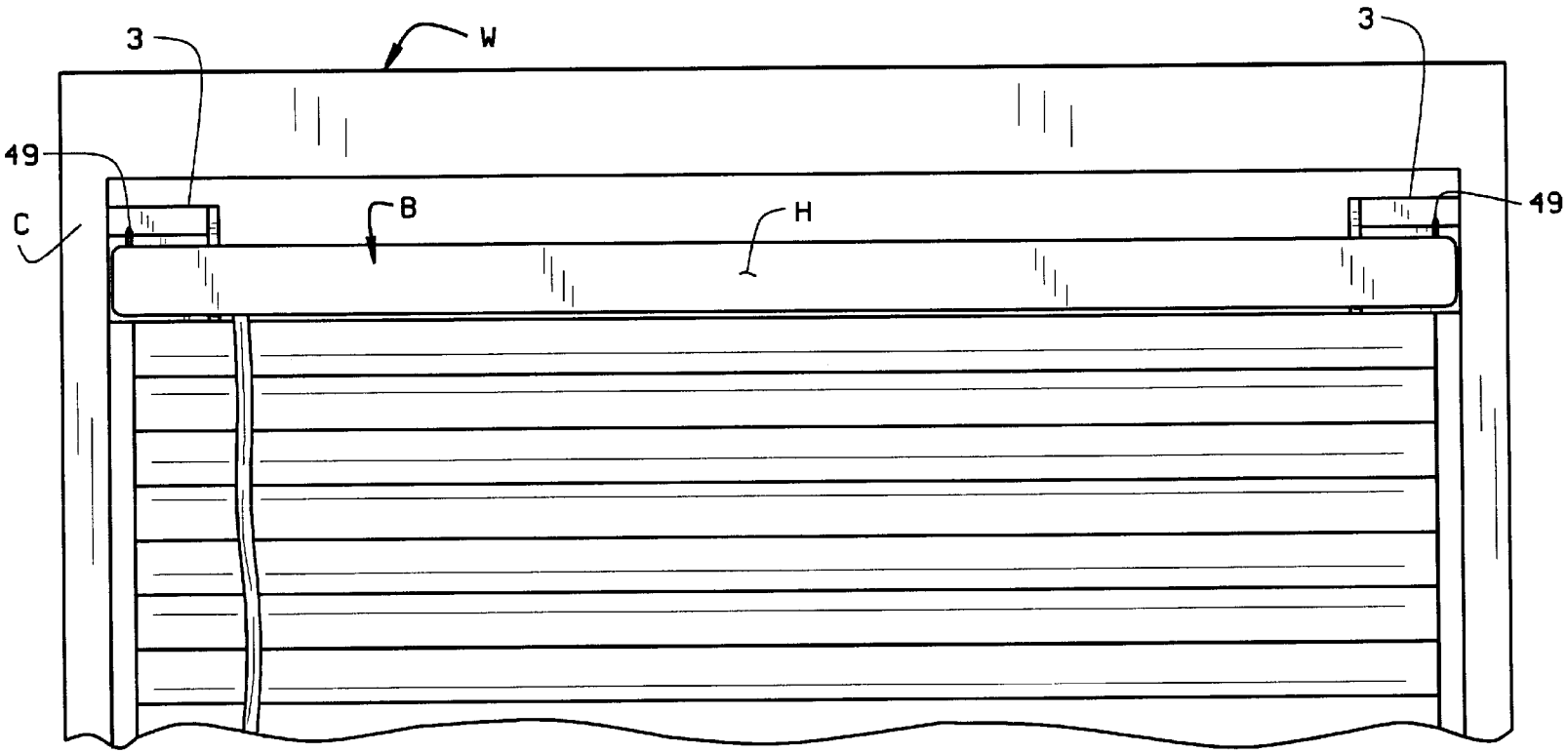
FIG. 7 shows a pair of brackets of the present invention in use to support a mini-blind in a window.
Figure 8:
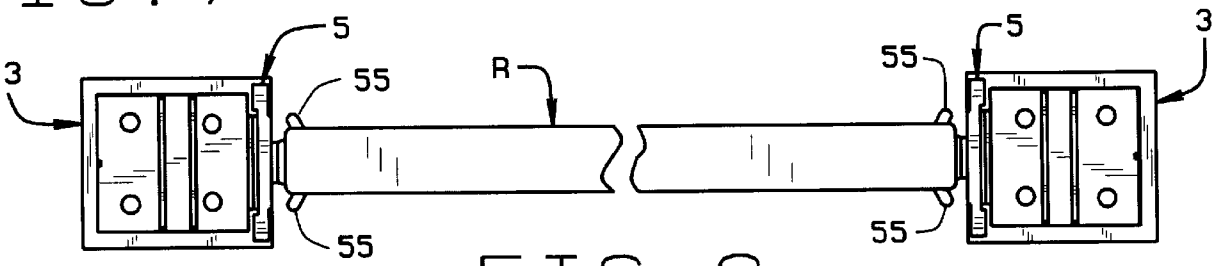
FIG. 8 shows a pair of brackets of the present invention in use to support a curtain rod in a window.

Turning generally to FIG. 1, the bracket system 1 of the present invention includes a mini-blind bracket 3 and a curtain rod adapter 5. The bracket 3 is formed generally as a box and has a back wall 7, a top wall 9, a bottom wall 11, and a side wall 13, all of which serve to define a chamber 15. The chamber 15, as can be seen, is open on one side and along its front. The bracket 3 is provided with screw holes 16 in the back wall 7 and side wall 9 to enable bracket 3 to be mounted in the casement C of a window W, as seen in FIGS. 7 and 8. That is, nails or screws can be passed through some, or all, of the holes 16 to securely mount the bracket 3 to the casement C.

Figure 3:
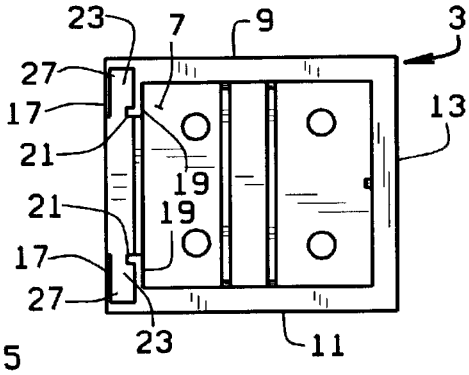
FIG. 3 is a front plan view of a mini-blind bracket of the bracket system.

An inwardly facing lip or flange 17 extends from the inner edges of the top and bottom walls 9 and 11. A second flange 19 extends from the top and bottom walls spaced from the first flange 17. A lip 21 extends from the end of the second flange 19 towards the first flange 21. As can be seen, the two flanges 17 and 19, and the associated lip 21 define a generally L-shaped channel 23. As best seen in FIG. 3, the top and bottom walls 9 and 11 are of reduced thickness at the channel 21. That is, the channel 21 is formed in part by a groove 27 formed in the top and bottom walls and by the flanges 17 and 19 which extend from the groove 27. A pair of spaced apart ribs 31 extend across the top, bottom, and back walls 7, 9 and 11, generally midway between the side wall 13 and the open side of the bracket 3. A further rib 33 runs from the back of the side wall 3 to the front thereof.

Figure 4:
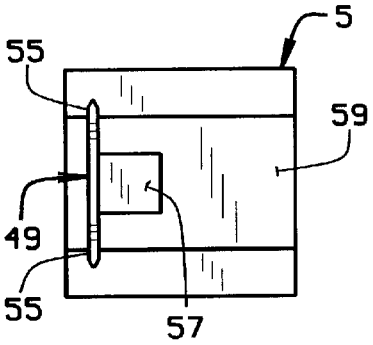
FIG. 4 is a front plan view of a curtain rod adapter for the bracket system.
Figure 5:
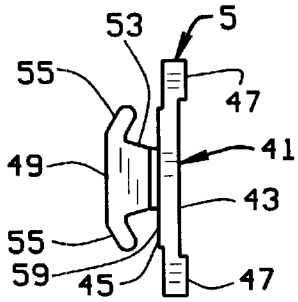
FIG. 5 is a side elevational view of the curtain rod adapter.
Figure 6:
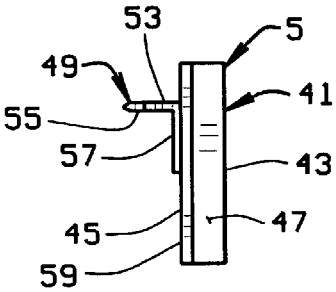
FIG. 6 is a top plan view of the curtain rod adapter.

The curtain rod adapter 5 includes a plate 41 having an inner surface 43 and an outer surface 45. Flanges 47 extend generally perpendicularly from the inner surface of the plate at the top and bottom edges thereof. The plate flanges 47 are sized and shaped to be received in the channels 23 of the bracket 3. A generally T-shaped member 49 extends generally Perpendicularly from the outer surface of the plate and is shaped and sized to receive the end of a curtain rod. The curtain rod receiving member 49 has a stem 53 which projects from the plate 41 and a pair of swept back arms 55 which extend toward the plate 41 and which give the member is T-shape. The adapter 5 may be molded as a single piece. Alternatively, the plate 41 and its flanges 47 can be molded from plastic and the curtain rod receiving member can be formed from metal. As shown in the drawings, the curtain rod receiving member 49 is formed from metal and has a base 57 which is fixed to the outer surface of the plate 41. The stem 53 then projects from the base 57. As can be appreciated, the base 57, stem 53, and arms 55 are stamped from one piece of metal and bent to shape. The base 57 can be glued to the plate 41, or the plate 41 can be molded around the base 57. In the embodiment shown in FIGS. 4–6, the adapter plate 41 includes a raised portion 59 which extends generally parallel to the flanges 47. The T-member base 57 is adhered to the raised portion 59.

As shown in FIG. 7, to use the brackets with a mini-blind B, a pair of opposing brackets are mounted in the casement C of the window W. The header H of the blind B is then slid into the chamber 23 and secured therein in any conventional manner.

To convert the bracket from a mini-blind bracket to a curtain rod bracket, the mini-blind B is removed from the bracket and the adapter 5 is simply slid into the channels 23. A conventional curtain rod R is then slipped over the T-shaped member, as is known in the art. As can be appreciated, this allows for the ability to place a curtain rod in a window which has or had mini-blinds without the need to directly mount further hardware to the casement of the window. Further, it does not require that further unsightly and undesired holes be made in the window frame or casement.

Figure 9:
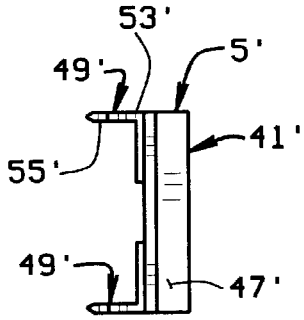
FIG. 9 is a perspective view of an alternative curtain rod adapter.

Turning to FIG. 9, an alternative embodiment 5' of the curtain rod adapter is shown. The adapter 5' is substantially similar to the adapter 5 of FIGS. 4–6 and includes a plate 41' which is substantially identical to the plate 41. This embodiment varies from the embodiment of FIGS. 4–6 in that it includes two T-members 49', rather than a single T-member. The two T-members 49 ' are substantially identical to the T-member 49. They are mounted to the plate 41' such that their stems 53' and arms 55' are near, or flush with, the edges of the plate 41' (i.e., the edges which extends between the flanges 47'). Thus, the two T-members 49' are spaced apart from each other. The provision of two T-members allows for more than one curtain rod to be mounted in the window, a feature which is desirable when two curtains are being placed in a window.

Figure 10:
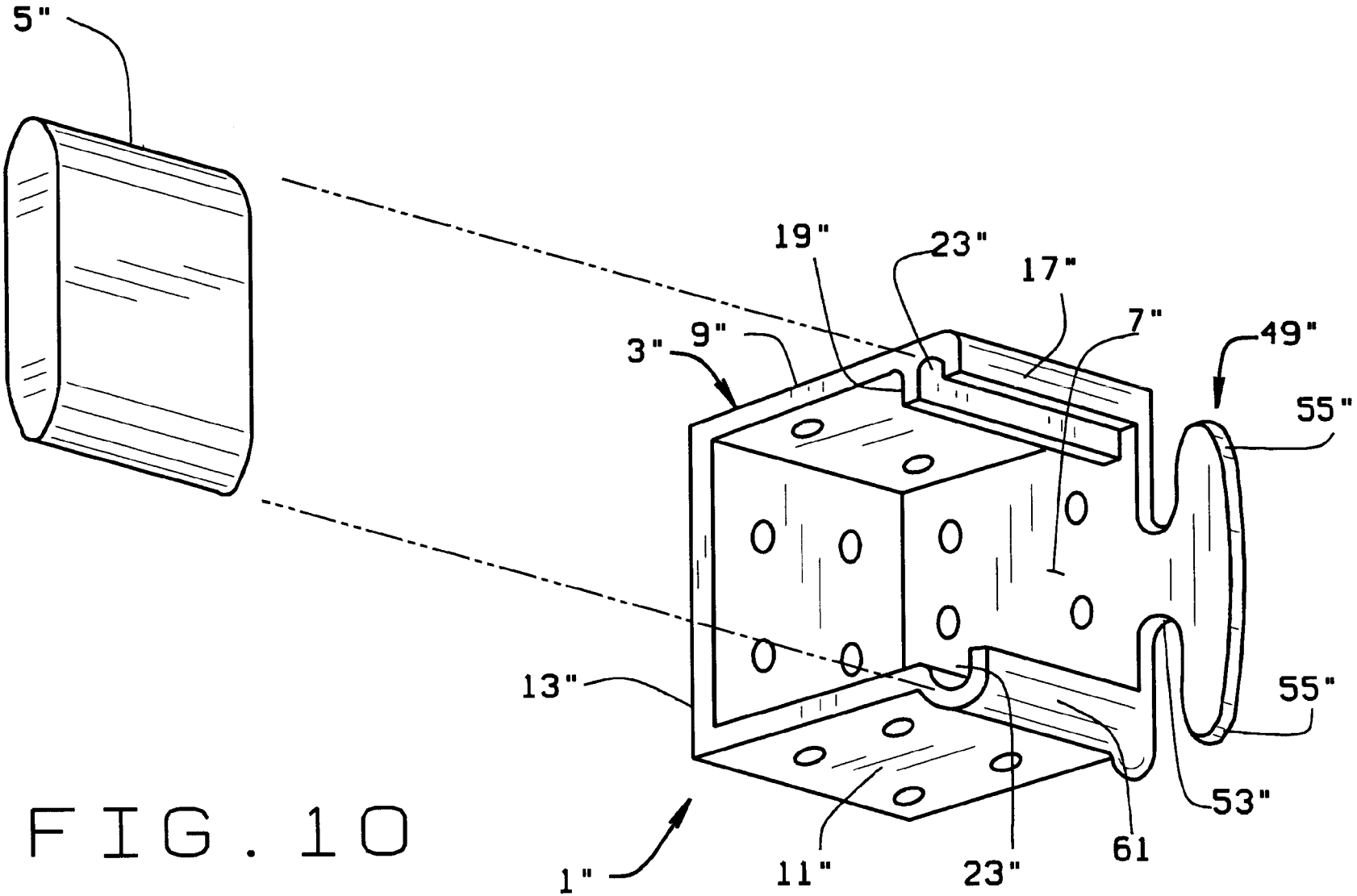
FIG. 10 is an exploded perspective view of a second embodiment of the bracket system, wherein the curtain rod adapter is part of the mini-blind bracket.

A second embodiment of the bracket 1" is shown in FIG. 10. The bracket 1" combines the mini-blind bracket 3" and the T-member 49" into a one-piece unit. The bracket 1" can be molded as a single unit as shown in FIG. 10, wherein the bracket 3" and T-member 49" are both made of plastic. Alternatively, the T-member 49" can be made of metal can be molded into the plastic bracket 3" or otherwise fixed to the plastic bracket 3".

The mini-blind bracket 3" is substantially similar to the bracket 3 and includes back, top, bottom, and side walls 7", 9", 11" and 13", respectively, and which have holes therein through which screws can pass to mount the bracket to the casement of a window. The T-member 49" extends from the edge of the back wall 7" at the side opening of the bracket 3". The T-member 49" thus is co-planar with, or parallel to the plane of, the back wall 7". The T-member 49", as can be seen, includes a stem 53" extending from the bracket back wall 7" and a pair of arms 55". The arms 55" are shown to extend perpendicularly from the stem 53".

Figure 2:
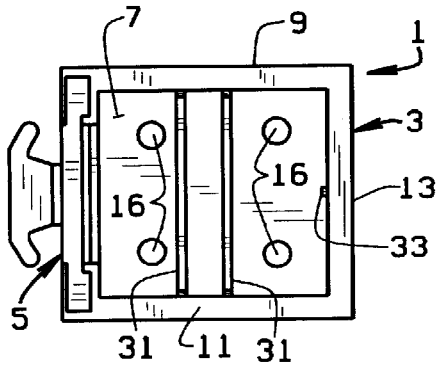
FIG. 2 is a front plan view of the bracket system.

The bracket 3" includes channels 23" in its top and bottom walls 9" and 11" to accept a face plate 5" which will close the opened side of the bracket. The channel in the top wall 9" is formed by a pair of spaced apart, generally parallel flanges 17" and 19". The bottom wall 11" includes a ridge 61 in which the channel 23" of the bottom wall 11' is formed. Thus, the channel in the bottom wall is not formed by flanges. Unlike the channels 23 of FIGS. 1–3, the channel 23" of FIG. 10 is a generally straight channel, that is, it is not L-shaped. However, the channels 23" could be formed identically to the channels 23 of FIGS. 1–3 if desired. This would allow the bracket 3" to accept either of the adapters 5 or 5'.

The bracket 1" is used identically to the bracket 1. If the user would like to mount two curtain rods in the window, the face plate 5" can be replaced with an adapter similar to the adapter 5 or 5' of FIGS. 4–6 and 9.

In view of the above, it will be seen that the several objects and advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense.

What is claimed is:

1. A bracket system capable of selectively supporting a curtain rod and a mini-blind in a window and being convertible between a first mode in which it supports a mini-blind and a second mode in which it supports a curtain rod, the bracket system including:

a bracket adapted to be mounted to a window casement which frames the window, the bracket having a rear wall, a bottom wall, a top wall, and a side wall, to define a chamber which has an open front and an open side, the chamber being sized to receive a header of the mini-blind; said top and bottom walls of said bracket having opposed channels formed to face each other; and a curtain rod adapter having a plate sized to extend between the top and bottom walls of the bracket and to be received in the channels and a member sized and shaped to receive an end of a curtain rod, said curtain rod receiving member extending generally perpendicularly from said plate.

2. The bracket system of claim 1 wherein the channel in the top and bottom walls of the bracket are defined by a pair flanges extending from inner surfaces of said top and bottom walls of said bracket, one flange of said pair of flanges having a lip which faces the other flange of said pair of flanges, said channel being generally L-shaped; said curtain rod adapter plate having an upper flange and a lower flange, said upper and lower plate flanges being received in said L-shaped channels.

3. The bracket system of claim 2 wherein the channels are formed at the open side of the chamber.

4. The bracket system of claim 3 wherein the curtain rod receiving member is generally T-shaped.

5. The bracket system of claim 3 wherein the curtain rod receiving member is located adjacent a front or back edge of said plate.

6. The bracket system of claim 3 wherein the curtain rod receiving member is located between front and back edges of said plate, said member being closer to one of said edges than the other.

7. The bracket system of claim 1 wherein the curtain rod adapter plate includes two curtain rod receiving members, said two members being spaced apart from each other.

8. The bracket system of claim 1 wherein the bracket includes a curtain rod receiving member extending from said rear wall at said bracket open side, said curtain rod receiving member being generally co-planar with said rear wall.

9. A bracket convertible between a mini-blind bracket and a curtain rod bracket, said bracket including:

a bracket adapted to be mounted to a window casement which surrounds and frames the window; the bracket having a rear wall, a bottom wall, a top wall, and a side wall, to define a chamber having an open side and an open front; the chamber being sized to receive a header of the mini-blind; said top and bottom walls having spaced apart first and second flanges extending from inner surfaces of said top and bottom walls; one of said flanges having a lip extending toward the other of said first and second flanges, said flanges defining a generally L-shaped channel; and a curtain rod adapter having a plate having top, bottom, front, and back edges and being sized to extend between the top and bottom walls of the bracket base, flanges extending generally perpendicularly from the top and bottom edges of said plate, and a generally T-shaped member extending from said plate, said T-member being adapted to receive an end of a curtain rod; said plate flanges and at least a portion of said plate being received in said bracket channels.

10. The bracket of claim 9 wherein said T-shaped member extends from a first side of said plate and said plate flanges extend from a second side of said plate.

11. A bracket convertible between a mini-blind bracket and a curtain rod bracket, said bracket including:

a box-shaped bracket adapted to be mounted to a window casement which frames the window, the bracket having a chamber having an open side and an open front, the chamber being sized to receive a header of the mini-blind; the chamber having a pair of spaced apart walls, said walls having spaced apart first and second flanges extending from said walls into said chamber, said first and second flanges being spaced apart from each other and generally parallel to each other, one of said flanges having a lip extending toward the other of said first and second flanges, said flanges and said lip cooperating to define a generally L-shaped channel; and a curtain rod adapter at least integral with the box-shaped bracket and having a member adapted to receive an end of a curtain rod, the curtain rod adaptor extending with respect to the bracket only outwardly therefrom.

12. The bracket of claim 11 wherein said bracket includes a rear wall, said curtain rod receiving member extending past an edge of said rear wall in a plane parallel with said rear wall.

13. The bracket of claim 11 wherein said adapter includes a plate having top, bottom, front, and back edges and being sized to extend between the top and bottom walls of the bracket base, flanges extending generally perpendicularly from the top and bottom edges of said plate, and said curtain rod receiving member, said plate flanges and at least a portion of said plate being received in said bracket channels, whereby, when said adapter is received in said box-shaped bracket, said convertible bracket functions as a curtain rod bracket, and when said adapter is removed from said box shaped bracket, said convertible bracket functions as a mini-blind bracket.

14. The bracket of claim 13 wherein the curtain rod receiving member of the curtain rod adapter is generally T-shaped.

15. The bracket of claim 14 wherein said generally T-shaped rod receiving member has a stem extending from said adapter plate, and a pair of oppositely directed arms at an end of said stem, said arms being swept back.

16. The bracket of claim 12, wherein the curtain rod receiving member is unitary with the box-shaped bracket.

17. The bracket of claim 16, wherein the curtain rod receiving member is generally T-shaped with a stem extending from the rear wall and a pair of oppositely directed arms at an end of the stem, the arms being swept back.

* * * * *